US009415321B2

(12) United States Patent
Harris et al.

(10) Patent No.: US 9,415,321 B2
(45) Date of Patent: Aug. 16, 2016

(54) SELF-SEALING BALLOON OR BLADDER

(71) Applicants: Jerome A. Harris, Saint Louis, MO (US); Maureen Ann McHale, Long Beach, CA (US); Suzanne Mills-Winkler, Long Beach, CA (US)

(72) Inventors: Jerome A. Harris, Saint Louis, MO (US); Maureen Ann McHale, Long Beach, CA (US); Suzanne Mills-Winkler, Long Beach, CA (US)

( * ) Notice: Subject to any disclaimer, the term of this patent is extended or adjusted under 35 U.S.C. 154(b) by 9 days.

(21) Appl. No.: 14/076,245

(22) Filed: Nov. 10, 2013

(65) Prior Publication Data

US 2014/0273718 A1 Sep. 18, 2014

Related U.S. Application Data

(60) Provisional application No. 61/729,293, filed on Nov. 21, 2012.

(51) Int. Cl.
*A63H 3/06* (2006.01)
*A63H 27/10* (2006.01)

(52) U.S. Cl.
CPC ..... *A63H 27/10* (2013.01); *A63H 2027/1041* (2013.01)

(58) Field of Classification Search
USPC ..... 446/220–226; 289/17; D21/438–440; 40/212–217; 383/3
See application file for complete search history.

(56) References Cited

U.S. PATENT DOCUMENTS

| | | | | | |
|---|---|---|---|---|---|
| 1,151,093 | A | * | 8/1915 | Du Bois | 446/220 |
| 1,158,206 | A | * | 10/1915 | Griffith | A63H 27/10 137/855 |
| 1,218,852 | A | * | 3/1917 | Gilpin | A63H 27/10 446/224 |
| 1,467,411 | A | * | 9/1923 | Witten | 446/222 |
| 1,680,287 | A | * | 8/1928 | Evans | 473/472 |
| 1,680,318 | A | * | 8/1928 | Callahan | 446/222 |
| 1,970,802 | A | * | 8/1934 | Johnson | 156/289 |
| 2,396,906 | A | * | 3/1946 | Windson | A63H 27/10 116/DIG. 9 |
| 2,510,883 | A | * | 6/1950 | Goldberg | 482/90 |
| 2,568,389 | A | * | 9/1951 | Elliot | 434/138 |
| 2,625,770 | A | * | 1/1953 | Steen et al. | 446/221 |
| 2,674,064 | A | * | 4/1954 | Gassaway | 446/224 |
| 2,734,308 | A | * | 2/1956 | Gassaway | 446/224 |
| 2,783,584 | A | * | 3/1957 | Venturella | 446/225 |
| 3,088,242 | A | * | 5/1963 | Rockovits | 446/220 |
| 3,339,717 | A | * | 9/1967 | Rakowitz | 206/69 |

(Continued)

*Primary Examiner* — Matthew B Stanczak
(74) *Attorney, Agent, or Firm* — Roy A. Ekstrand

(57) ABSTRACT

A self-sealing balloon or bladder is fabricated of a flexible elastic material and defines a body to which a filler neck is secured. The filler neck is joined to the body to form a fill opening therebetween. The self-sealing structure is provided by bending the filler neck upon and against the surface of the balloon or bladder body. An attachment such as adhesive, tape or sonic welding is utilized to secure the filler neck against the inflatable body. The balloon or bladder may then be filled through the filler neck by the introduction of a flowable material such as a liquid, gas, or powder under pressure to fill and expand the body. Once the filling apparatus has been withdrawn, the elasticity and fill material within the body cooperate to maintain closure of the fill opening.

2 Claims, 6 Drawing Sheets

(56) References Cited

U.S. PATENT DOCUMENTS

| | | | | | |
|---|---|---|---|---|---|
| 3,523,563 | A | * | 8/1970 | Mirando | 141/313 |
| 3,783,551 | A | * | 1/1974 | Allison et al. | 446/222 |
| 4,917,646 | A | | 4/1990 | Kieves | |
| 5,169,353 | A | * | 12/1992 | Myers | A63H 3/06 446/221 |
| 5,188,558 | A | | 2/1993 | Barton et al. | |
| 5,199,685 | A | * | 4/1993 | Larseneur | 251/212 |
| 5,248,275 | A | | 9/1993 | McGrath et al. | |
| 5,295,892 | A | | 3/1994 | Felton | |
| 5,378,299 | A | | 1/1995 | McGrath et al. | |
| 5,799,377 | A | * | 9/1998 | Carroll et al. | 24/30.5 R |
| 6,015,472 | A | | 1/2000 | Garcia | |
| 6,736,793 | B2 | | 5/2004 | Meyer et al. | |
| 7,922,116 | B2 | | 4/2011 | Nguyen et al. | |
| 8,349,417 | B2 | | 1/2013 | Heffernan | |

* cited by examiner

SELF-SEALING BALLOON OR BLADDER

CROSS-REFERENCE TO RELATED APPLICATIONS

This application claims the benefit of and priority under 35 U.S.C. 119(e) of U.S. Provisional Patent Application No. 61/729,293,entitled SELF-SEALING BALLOON OR BLADDER, filed Nov. 21, 2012 in the names of Jerome Harris, Maureen McHale and Suzanne Mills-Winkler, the disclosure of which is incorporated herein by reference.

FIELD OF THE INVENTION

This invention relates generally to flexible fluid-filled balloons and bladders filled with fluids and/or other flowable material, such as powder, or the like, and particularly to the sealing mechanism utilized therein.

BACKGROUND OF THE INVENTION

Balloons have proven to be an extremely pervasive and popular amusement device having been utilized by countless generations of children and adults. While balloons vary substantially in shape and size, all generally provide a fluid impervious continuous skin often formed to define a desired shape. The skin includes an extending usually tubular neck portion. The function of the neck portion is to provide for the introduction of a fluid under pressure to fill the interior of the balloon's skin. The balloon skin and neck are typically formed of a flexible resilient continuous structure available in a countless variety of colors and appearances. Most balloons utilize a skin and neck integrally formed of a resilient material such as rubber, latex or flexible resilient plastic materials. The essential characteristic of the balloon skin and neck material is to provide a skin which is largely impervious to the fluid to be introduced into the balloon. Additionally, balloons may be formed of various polymer materials such as mylar or the like to provide a somewhat different structure. In most such balloons, the material utilized is in thin sheet form and is typically flexible but not capable of extensive stretching. In a common construction found to be economically suitable, a pair of substantially mirror-image sheets of this material is joined along the outer edges thereof to provide a fluid confining volume.

In generally related technologies, fluid bladders generally resemble resilient stretchable rubber or latex-type balloons but find their use in more commercially oriented environments. Thus, such resilient fluid bladders are often used within a confining enclosure or container to provide a sealed volume of fluid. In this type of application, the confining enclosure or container may be a shipping container or, alternatively, may be a relatively unstretchable sports article such as a football, basketball or soccer ball. The essential function provided in such bladders is similar to the function desired in balloons which is simply to provide a reliable sealed container for the fluid therein.

The typical resilient stretchable balloon which is generally most pervasive in the party and amusement applications is formed of a rubber or latex material which enjoys extensive popularity due in part to its easy inexpensive manufacture as well as its ability to provide a virtually endless variety of colors. For the most part, such balloons are formed over a mandrel or plug which is dipped into the liquid rubber or latex material to provide a thin film upon the mandrel or plug afterwhich cooling in a liquid such as water fixes the material. The completed balloon is then simply rolled from the mandrel or plug.

In the most pervasive and well know play patterns for balloons, air is introduced through the balloon neck under pressure to provide a confined volume of air within the balloon skin. As the pressure within the skin is increased, the resilient stretchable characteristic of the skin allows the balloon to expand or be "blown-up". Once the desired extent of inflation of the balloon has been accomplished, the user typically seals the fluid within the balloon by simply tying a knot in the balloon neck. Balloons may be inflated with pump apparatus or simply blown-up by placing the balloon neck end into the user's mouth and blowing into the balloon. The resulting air-filled balloon is close to neutral in its buoyancy within the air allowing it to float to some degree within the air and have a general characteristic to descend when not touched by the user.

In other play patterns utilizing such stretchable flexible balloons, an alternative gas such as helium or the like selected for its lighter weight relative to air is used to inflate the balloon. The inflation process is the same as pressurized gas such as helium is introduced through the balloon neck causing the confined volume of gas within the balloon to stretch and expand the balloon. Once again, the seal of the gas within the inflated balloon is typically carried forward by simply tying off the balloon neck. The resulting play article is substantially buoyant in the air due to the lighter weight of the confined gas within the balloon. Thus, such lighter than air gas-filled balloons float and will rise unless restrained by a tether or the like.

In still play patterns, balloons are filled with a heavier liquid type fluid such as water. Water filling a typically stretchable resilient balloon provides a volume of water confined within the balloon skin which due to its weight and a slight fluid pressure will expand the balloon's skin to enlarge the balloon somewhat. Typically, water-filled balloons are not expanded to the size increase which characterizes balloons filled with air, helium or other gases. Once again, the fluid seal is attained by simply tying off the filler neck of the balloon. Filling a typical resilient stretchable balloon with a fluid such as water provides a flexible heavy amusement device which has proven enjoyable to manipulate and use in play patterns. Because the typical balloon filled with water will burst when impacted, the play patterns which involve launching or throwing balloons at or toward a target object causing them to burst on impact have proven to be an amusing and often mischievous play pattern.

Despite the extensive popularity and proliferation of balloons as amusement devices, a vexing problem has persisted in sealing the fluid within the filled balloon. While practitioners in the art have attempted to solve this problem with various valves, fluid traps and the like, the resulting apparatus has been largely unsuccessful due the increase in costs and increase in balloon weight which they produce. Thus, while simply tying the filler neck of a balloon is not a perfect solution for sealing the fluid therein due to the often difficult and tedious process in tying a suitable knot and attaining a suitable seal, it remains the best alternative to date.

The need to improve balloon sealing has prompted practitioners in the art to try a variety of devices. For example, U.S. Pat. No. 4,917,646 issued to Kieves sets forth a SELF-SEALING VALVE, A SELF-SEALING, NON-LATEX BALLOON, AND METHOD FOR PRODUCING SUCH A BALLOON sets forth a sealing apparatus for use in a balloon having an elongated filler neck and a reservoir body within which a valve fabricated from a pair of flexible plastic sheets bonded together is situated within the filler neck. The valve sheets separate during filling and are pressed closed by internal pressure to affect balloon seal.

U.S. Pat. No. 5,248,275 issued to McGrath, et al. sets forth a BALLOON WITH FLAT FILM VALVE AND METHOD OF MANUFACTURE having a balloon defining a reservoir and a filler neck. A pair of flat flexible valve elements are supported within the balloon interior proximate the junction of the filler neck and balloon reservoir. During filling the filling pressure separates the flat valve elements while, once filled, a seal is created by the flat plates being driven together.

U.S. Pat. No. 5,188,558 issued to Barton, et al. sets forth a SELF-SEALING REFILLABLE PLASTIC BALLOON VALVE utilizing a pair of plastic film sheets supported within the valve filler neck and are bonded thereto.

U.S. Pat. No. 8,349,417 issued to Hefferman sets forth a SELF-SEALING INFLATABLE ARTICLE having an inflatable body portion and filling neck connected thereto. A ring member supporting the opening of the filler neck and a plug member for sealing the opening cooperate to provide balloon sealing.

U.S. Pat. No. 6,736,793 issued to Meyer, et al. sets forth a SELF-SEALING DETACHABLE BALLOON having an inflatable balloon body supporting a self-sealing valve. The balloon is formed of an elastomeric membrane having a fill opening. The self-sealing valve is made up of a valve body for receiving an inflation instrument to inflate the balloon. Once the inflation instrument is withdrawn, the valve closed to complete sealing of the balloon.

U.S. Pat. No. 7,922,116 issued to Nguyen, et al. sets forth a DEVICE AND METHOD FOR SEALING AND LIGHTING A BALLOON utilizing a balloon having a fillable reservoir and filler neck. A combination valve and battery-powered light source is inserted into the balloon neck to provide sealing and illumination of the balloon interior.

U.S. Pat. No. 5,295,892 issued to Felton sets forth a BALLOON HAVING SELF SEALING VALVE AND METHOD OF MAKING SAME providing a fillable elastic balloon reservoir and fill neck coupled thereto. The neck supports a valve utilized in allowing pressurized fluid to pass through the valve into the interior and providing valve closure once the fill instrument has been withdrawn.

U.S. Pat. No. 6,015,472 issued to Garcia sets forth METHOD OF PRODUCING A BALLOON WITH SELF-SEALING VALVE while U.S. Pat. No. 5,378,299 issued to McGrath, et al. sets forth a METHOD OF MAKING A BALLOON WITH FLAT FILM VALVE, both of which provide methods and apparatus for fabricating self-sealing balloons.

While the foregoing described prior art devices have to some extent advanced the balloon art and in some instances endeavored to achieve commercial success, there remains nonetheless a continuing need in the art for an improved seal method and apparatus which readily and reliably seals a fluid-filled balloon without substantially increasing the weight or without an intricate complex operation.

SUMMARY OF THE INVENTION

The present invention provides a self-sealing balloon or bladder apparatus utilizing a resilient stretchable material balloon having a closed skin fluid reservoir coupled to an extending filler neck. In accordance with the invention, the filler neck of the balloon is folded back upon the body of the balloon skin and secured to the underlying portion of the balloon skin to fix the filler neck against the underlying balloon body surface. The fixing of the filler neck against the balloon body surface may be provided using a suitable adhesive material, a double-sided tape or other fixing methods and apparatus. The resulting balloon structure or bladder provides a suitable structure for quickly filling or inflating the balloon and sealing the confined fluid within the balloon interior. The closure of the balloon is provided by the captivation and attachment of the filler neck upon the outer surface of the balloon body. A reliable seal is provided once the fluid has been introduced under pressure by the action of the confined fluid volume of within the balloon exerted against the balloon skin and restrained neck secured to the balloon body. The self-sealing balloon or bladder readily accommodates an automated system of filling balloons and may further accommodate and automated system which dispenses individual balloons in a cartridge or clip form to create multiple-filled balloons in a short period of time.

In accordance with the present invention, there is provided a self-sealing balloon comprising: a balloon, formed of an elastic material, having an expandable body defining an interior and an outer skin surface and a filler neck integrally formed with and extending from the expandable body having a fill passage in communication with the interior; a portion of the neck folded upon and against the outer skin surface; and an attachment interposed between the portion of the neck and the outer skin surface securing the portion of the neck to the outer skin surface, the expandable body expanding as a flowable material is introduced through the filler neck and forcing closure of the fill passage once the introduction of flowable material ceases.

In certain embodiments, the present invention provides a self-sealing balloon comprising: an inflatable balloon body defining an interior cavity and surrounding skin; a filler neck, joined to the balloon body, having a fill passage in communication with the interior, the filler neck having at least a portion thereof folded upon the surrounding skin; and attachment means interposed between the filler neck and the skin to secure the at least a portion to the surrounding skin.

In a more general sense, the present invention provides a self-sealing flowable material vessel comprising: a body having a skin surrounding an interior cavity and a fill aperture; a filler neck defining a fill passage joined to the skin at the fill opening, the filler neck being folded upon a portion of the skin; and an attachment interposed between the filler neck and the skin to secure the filler neck to the skin.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

By way of overview, the present invention self-sealing balloon or bladder is obtained by providing a low cost, relatively easy modification of an otherwise conventional balloon or bladder. Such conventional balloons are formed of a unitary structure having a body enclosing an empty volume and a filler neck extending from the body. The neck defines a filler passage extending into the body interior volume. In most balloons, the outer end of the filler neck is rolled to form a neck rim or bead. The neck rim facilitates automated filling apparatus. Thus, a typical balloon formed of a stretchable resilient material such as rubber, latex or plastic is adapted to provide a self-sealing balloon by folding the filler neck of the balloon against the adjacent skin portion of the balloon and securing the filler neck thereto by a suitable attachment. The anticipated attachment utilized between the filler neck and the balloon skin may be provided through the use of adhesive, tape or other attachment apparatus such as sonic or thermal welding. Once the filler neck has been confined against the balloon skin, the introduction of fluid under pressure through the neck into the interior of the balloon causes the balloon body to expand. The pressure of the introduced fluid together with the elasticity of the balloon body cooperates to exert a force against the skin portion of the balloon surrounding the balloon neck as well as the neck itself. The continued introduction of fluid under pressure increases the force applied to the balloon skin against the confined balloon neck. This provides a reliable seal of the neck opening once the inflating apparatus is removed. It will be understood that the present invention contemplates filling a balloon, or bladder, with a substance that may be pumped or otherwise caused to flow into a balloon or bladder. Thus, the fill substance may be virtually any flowable material including, but not limited to, a gas, liquid, gel, powder or particulate material. Accordingly, in the descriptions and claims set forth herein, the terms "fluid" and "flowable material" may be used interchangeably and are not for exclusion.

Figure 1:
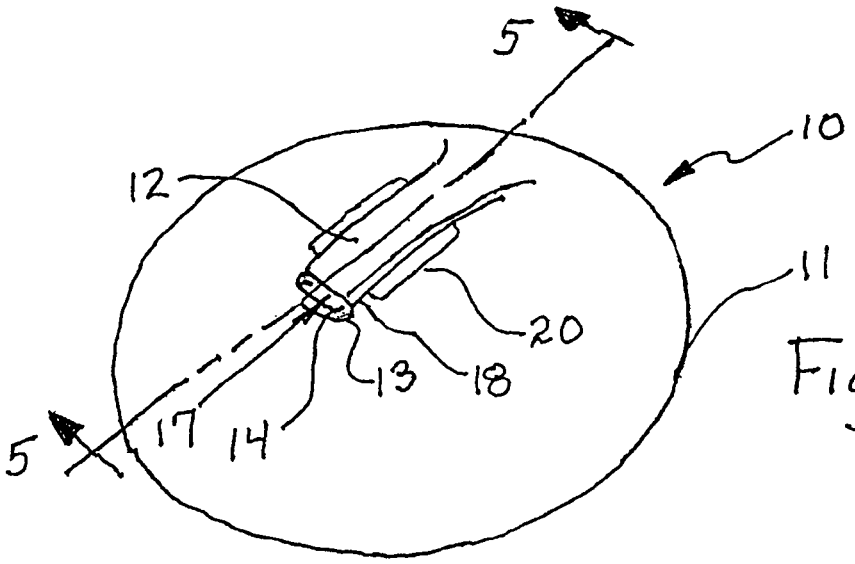
FIG. 1 sets forth a perspective view of a self-sealing balloon constructed in accordance with the present invention in an inflated condition.

More specifically, FIG. 1 sets forth a perspective view of a self-sealing balloon constructed in accordance with the present invention and generally referenced by numeral 10. It should be noted that the figures and descriptions which follow set forth the present invention in embodiments which comprise self-sealing balloons. It will be understood, however, that the descriptions and the operation of the present invention which follow for the self-sealing balloon embodiments are equally applicable to and bear equal importance with respect to flexible fluid-confining bladders of various types.

Figure 5:
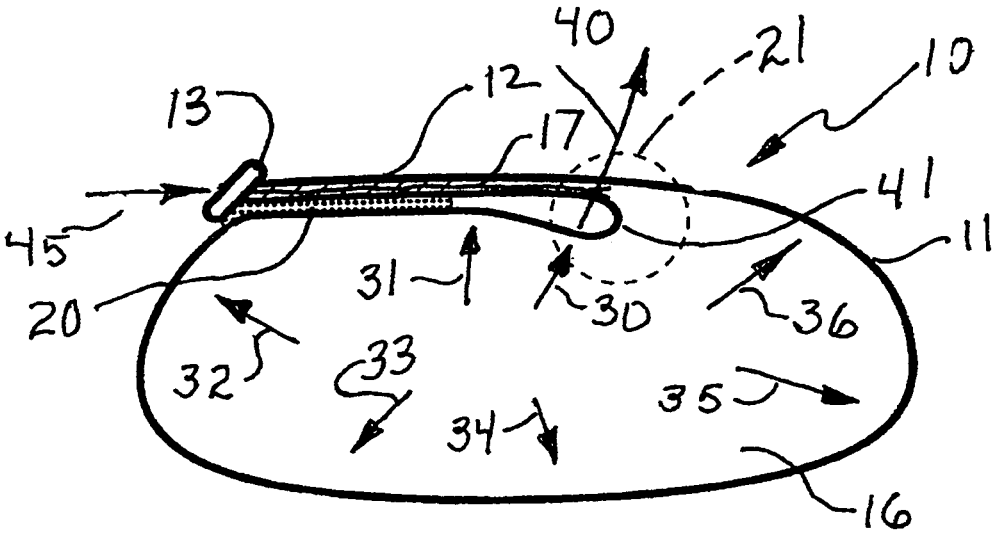
FIG. 5 sets forth a section view of the present invention self-sealing balloon taken along section lines 5-5 in FIG. 1 showing the balloon in a generally deflated state.
Figure 6:
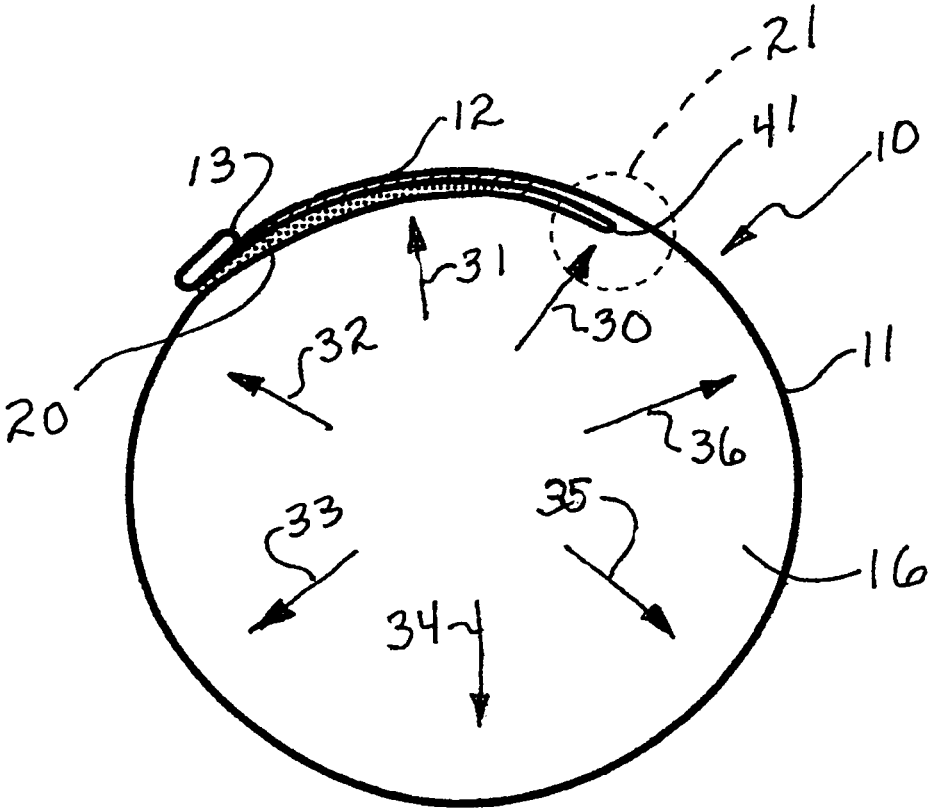
FIG. 6 sets forth the section view of the present invention self-sealing balloon shown in FIG. 5 depicting the balloon in an inflated state.

Returning to FIG. 1, balloon 10 includes a resilient stretchable skin 11 formed to confine an interior volume (seen in FIGS. 5 and 6). Skin 11 is coupled to a filler neck 12 which is preferably continuously formed with skin 11. Filler neck 12 defines a neck aperture 14 surrounded by a neck rim 13. While not seen in FIG. 1, it will be apparent to those skilled in the art that filler neck 12 is hollow and generally cylindrical and thus includes a filler passage extending therethrough. Neck 12 and neck rim 13 provide a means for holding balloon 10 and for introducing fluid under pressure into the interior of skin 11. In accordance with the present invention, a quantity of adhesive 20 is deposited upon skin 11 in proximity to filler neck 12. In further accordance with the present invention, filler neck 12 has been folded upon skin 11 in the manner shown in FIG. 1 and as is better seen below in FIGS. 5 and 6. Of importance with respect to the present invention is the attachment and restriction of movement exerted against filler neck 12 by adhesive deposit 20. It will be noted that while a deposit of adhesive material is suitable for fixing filler neck 12 against skin 11, other fixing and attachment apparatus such as double-sided tape or processes such as sonic or chemical welding may be utilized without departing from the spirit and scope of the present invention. Thus, in FIG. 1 and the descriptions which follow, adhesive 20 serves to be merely illustrative of a variety of suitable attachment apparatus which may be used to secure filler neck 12 against skin 11 of balloon 10. It will be further noted that the embodiment of the present invention set forth in FIG. 1 (balloon 10) shows adhesive 20 ending upon filler neck 12 to define a gap 18 between rim 13 and adhesive 20. Gap 18 facilitates the grip of neck 12 required by automatic filling apparatus.

In accordance with the present invention once balloon 10 has been inflated to define a closed fluid volume such as the generally spherical balloon shown in FIG. 1, the inflated balloon by means described below in greater detail utilizes the interior pressure within the balloon skin together with elasticity thereof to exert a force against the restrained condition of filler neck 12 to accomplish a seal which maintains the integrity of balloon 10 and which confines the pressurized fluid therein. It will be noted that while the preferred fabrication of the present invention utilizes an elastic and stretchable balloon, a bladder, or the like, formed of more or less non-stretchable material may be used.

It should also be noted in conjunction with FIG. 1 that the filled condition of balloon 10 and the sealing function applied to filler neck 12 allow balloon 10 to be used in accordance with the various conventional balloon play patterns. It will be further noted that while it is anticipated that the embodiment of the invention shown in FIG. 1 utilizes a generally spherical balloon having a quantity of a gas fluid therein, the embodiment of FIG. 1 applies equally well to other shaped balloons and to balloons filled with a liquid material such as water or other flowable material, such as powder.

Figure 2:
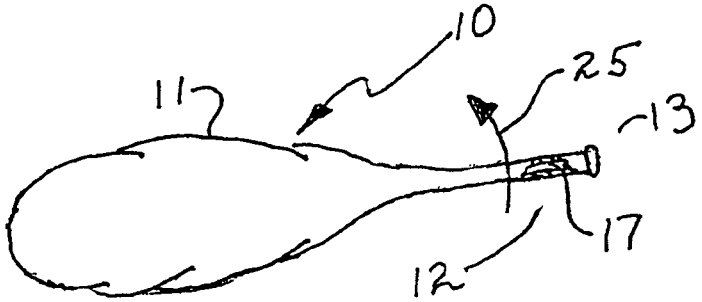
FIG. 2 sets forth a side elevation view of a conventional balloon in a deflated state.
Figure 3:
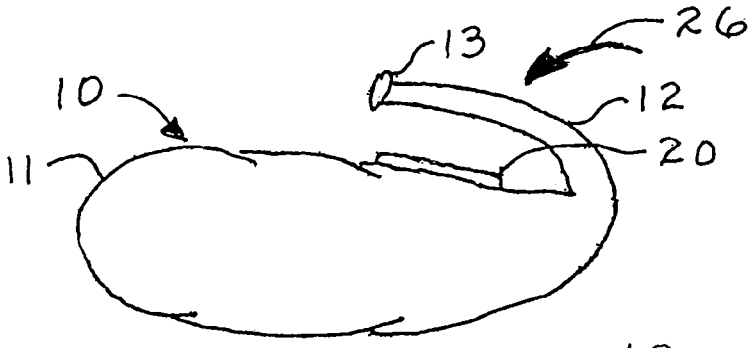
FIG. 3 sets forth the deflated balloon of FIG. 2 having been modified with the present invention improvement.
Figure 4:
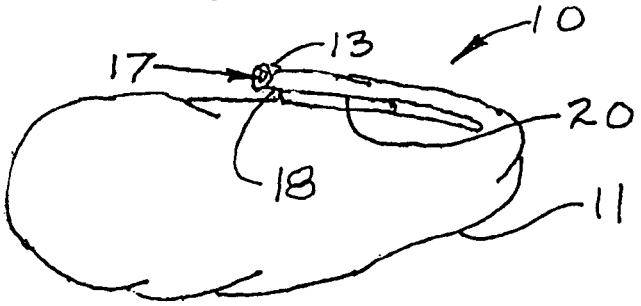
FIG. 4 sets forth the present invention balloon in a deflated state.

FIGS. 2, 3 and 4 set forth sequential views illustrating the adaptation of balloon 10 to provide the present invention self-sealing balloon. In FIG. 2, balloon 10 is shown in its initial conventional fabrication. In FIG. 3, balloon 10 is shown in a relaxed or deflated condition having a quantity of adhesive deposited upon the balloon skin. Finally, in FIG. 4, balloon 10 is shown in completed fabrication with neck 12 secured to balloon skin 11 while still in a generally deflated condition.

More specifically, FIG. 1 sets forth a conventional balloon 10 which has yet to be configured to provide the present invention self-sealing balloon. Thus, balloon 10 is shown having a relaxed generally spherical skin 11 joined to an extending generally cylindrical neck 12. For purposes of illustration, neck 12 is shown partially sectioned to expose interior neck passage 17. Neck 12 terminates in an annular rim 13 which encircles the entrance to neck filler passage 17. The fabrication of the present invention self-sealing balloon is initiated by flexing and folding neck 12 upwardly in the direction indicated by arrow 25.

FIG. 3 sets forth a side elevation view of balloon 10 at the next step of fabrication to provide the present invention structure. Thus, as described above, balloon 10 includes a generally bulbous skin 11 having an elongated generally cylindrical filler neck 12 supporting a rim 13. In accordance with the present invention, a deposit of adhesive material 20 is now placed upon a selected portion of balloon skin 11. The position of adhesive 20 is selected to provide attachment between filler neck 12 and the underlying portion of balloon skin 11. Thus, as neck 12 is further folded upon balloon skin 11 in the direction indicated by arrow 26, filler neck 12 is moved into alignment with adhesive material 20.

FIG. 4 sets forth balloon 10 at the completion of fabrication while remaining in a generally relaxed deflated configuration. As described above, balloon 10 includes a resilient generally bulbous skin 11 having a generally cylindrically filler neck 12 extending therefrom. Filler neck 12 includes a bead 13 surrounding a filler aperture 17. In accordance with the present invention, filler neck 12 is folded upon bulbous skin 11 and secured thereto by an adhesive deposit 20. As mentioned above, gap 18 formed between rim 13 and adhesive 20 allows filler neck 12 to be gripped by automated filling apparatus. It will be noted that the position in which filler neck 12 is secured against the underlying portion of balloon skin 11 restricts or confines filler neck 12 from further movement. It will be apparent to those skilled in the art that the fabrication of the present invention self-sealing balloon which utilizes an otherwise conventional inflatable balloon may be carried forward with a minimum of expense and labor. In this manner, very little significant weight is added to balloon 10 by virtue of the use of adhesive deposit 20. The resulting balloon once inflated is suitable for the anticipated methods of balloon play to be enjoyed by the user.

FIG. 5 sets forth a section view of balloon 10 taken along section lines 5-5 in FIG. 1. As described above, balloon 10 includes a generally bulbous skin 11 supporting an extending filler neck 12. As is also described above, filler neck 12 includes a bead 13 and an internal neck passage 17. Neck passage 17 extends into interior 16 of balloon skin 11. In accordance with the present invention, an adhesive material deposit 20 is received upon balloon skin 11 and secures a portion of filler neck 12 against the underlying surface of balloon skin 11. Of particular importance with respect to the present invention is found is an area indicated by dashed-line 21 in which the portion of filler neck 12 which joins balloon skin 11 is folded over.

In operation, a quantity of flowable material such as a fluid under pressure which may be air or other gas or a liquid such as water is introduced into filler neck 12 in the direction indicated by arrow 45. It should also be noted that other flowable material such as a powder may be used to fill the balloon or bladder. The pressure of introduced fluid produces a fluid flow through neck passage 17 into interior 16 of balloon skin 11. The confined position of filler neck 12 forms fold portion 41 within interior 16. As the fluid introduced into interior 16 under pressure continues to flow, a confined volume of fluid under pressure within interior 16 is formed. This confined pressurized fluid volume provides a force exerted outwardly and generally uniformly within interior 16 against skin 11 as indicated by arrows 30 through 36. Of importance with respect to the present invention, the outward pressure upon skin 11 and neck 12 near fold 41 collapses fold 41 forcing the portion of skin 11 and neck 12 adjacent thereto outwardly in the manner indicated by arrow 40. This outward force further collapses the portion of skin 11 adjacent fold 41 against the proximate portion of filler neck 12. As fluid under pressure continues to be injected through neck 12, the pressure within interior 16 continues to increase stretching skin 11 and causing skin 11 to form balloon 10 into the generally inflated condition shown in FIG. 6.

FIG. 6 shows the section view of balloon 10 taken along section lines 5-5 in FIG. 1 once balloon 10 has been suitably inflated. In the example shown in FIG. 6, it is assumed that the fluid introduced into interior 16 of balloon 10 is a gas resulting in a generally spherical-shaped balloon. It will be recognized that the introduction of a liquid or powder while behaving generally the same as a gas in sealing the neck opening likely would not produce the spherical shape shown in FIG. 6 but rather generally conform to a shape corresponding more to the shape shown in FIG. 5.

In the inflated condition of FIG. 6, balloon 10 assumes a generally spherical shape such that skin 11 defines a sphere and the confined gas within interior 16 of balloon 10 produces a generally uniform outwardly directed force indicated by arrows 30 through 36. Of importance with respect to the present invention, the confinement of neck 12 against the underlying portion of skin 11 provided by adhesive 20 secures neck 12 such that fold 41 shown within dashed line area 21 assumes a flattened configuration. The outward force shown by arrow 30 operates upon fold 41 forcing the adjacent skin and neck portion into a flattened sealed configuration. This outward force is further active upon the remaining portions of skin 11 and, most importantly, the adjacent portions of neck 12. This force in turn collapses neck passage 17 (seen in FIG. 5) providing further closure of neck 12 and further sealing of interior 16 of balloon 10.

Thus, it will be apparent by examination of FIG. 6 that the uniform outwardly directed pressure of confined fluid within volume 16 forces skin 11 outwardly and maintains the seal and closure of neck 12. In the absence of the confinement and restraint of neck 12 provided by adhesive 20, the pressurized fluid within interior 16 would simply be expelled through neck passage 17. It will also be apparent by examination of FIG. 6 that the resulting inflated object provided by balloon 10 is a substantially more desirable play and amusement object due to the generally spherical character provided as neck 12 is restrained against the surface of skin 11. This is in substantial contrast to the article provided when a conventional balloon is inflated and the neck is simply tied to provide a seal.

Figure 7:
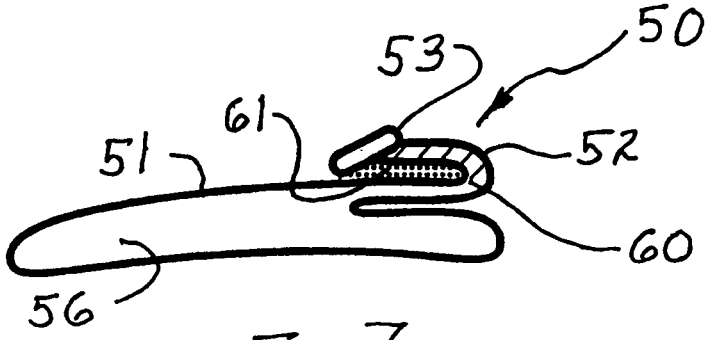
FIG. 7 sets forth a section view of an alternate embodiment of the present invention self-sealing balloon in a generally deflated state.

FIG. 7 sets forth a section view of an alternate embodiment of the present invention self sealing balloon generally referenced by numeral 50. Balloon 50 is substantially similar to balloon 10 described above with the difference being found in a shorter neck balloon. Thus, FIG. 7 shows balloon 50 in a relaxed deflated state. In accordance with the present invention, balloon 50 includes a bulbous skin 51 defining an interior 56 an a filler neck 52. Neck 52 includes a bead 53 and is folded at a fold 60. The remainder of neck 52 is secured to skin 51 by an adhesive 61.

Figure 8:
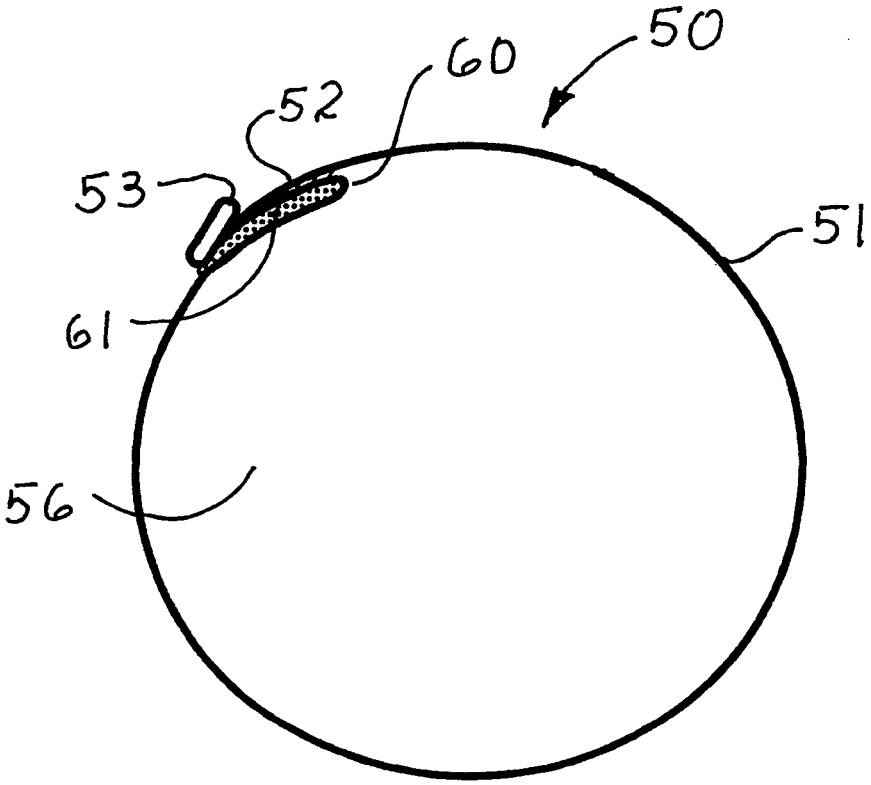
FIG. 8 sets forth a section view of the alternate embodiment of the present invention self-sealing balloon shown in FIG. 7 in an inflated condition.

FIG. 8 shows balloon 50 following inflation to form a generally spherical shape. Balloon 50 includes an interior 56, a neck 52 and a bead 53. Neck 52 remains secured to skin 51 by adhesive 61. In accordance with the invention, fold 60 is compressed by the pressure of the inflating fluid within interior 56 to provide a seal for balloon 50.

Figure 9:
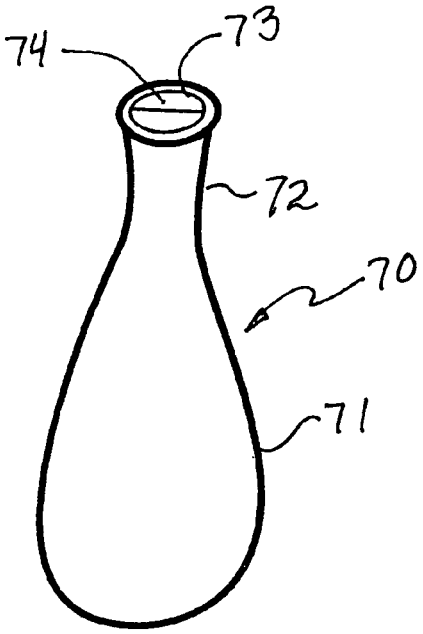
FIG. 9 sets forth a perspective view of an alternate embodiment of a self-sealing balloon constructed in accordance with the present invention in a deflated condition.

While the above-described embodiments have proven to provide effective balloon seal, it may in some instances, such as heavier bladders, be advantageous to provide supplement sealing apparatus. Accordingly, FIG. 9 shows a perspective view of a further alternate embodiment of the present invention balloon generally referenced by numeral 70. Balloon 70 is fabricated in accordance with conventional techniques and includes a resilient skin 71 formed to an elongated neck 72 which, in turn, terminates in an open mouth 73. A flapper valve 74 is supported within mouth 73 and, as is better seen in FIG. 12, includes a pair of over-lapping valve flaps 76 and 77. Valve 74 may be used in combination with the above-described attached neck sealing system or used alone.

Figure 10:
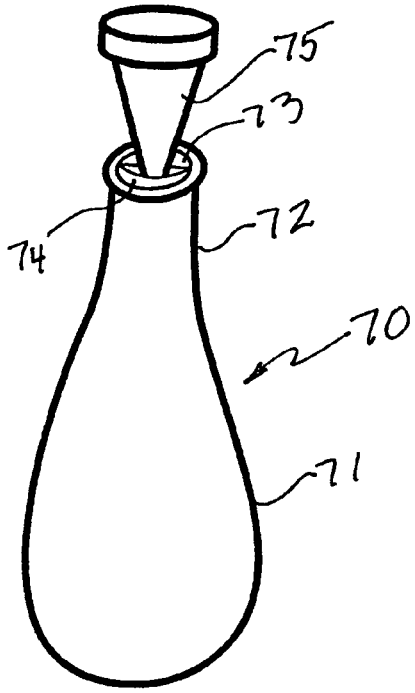
FIG. 10 sets forth a perspective view of the alternate embodiment of a self-sealing balloon set forth in FIG. 9 in a deflated condition and having an inflation nozzle inserted therein.

FIG. 10 sets forth a perspective view of balloon 70 having skin 71, neck 72 and mouth 73. Also shown is valve 74. To fill or inflate balloon 70, a nozzle 75 is shown partially inserted into valve 74. It will be noted that flaps 76 and 77 part to receive nozzle 75.

Figure 11:
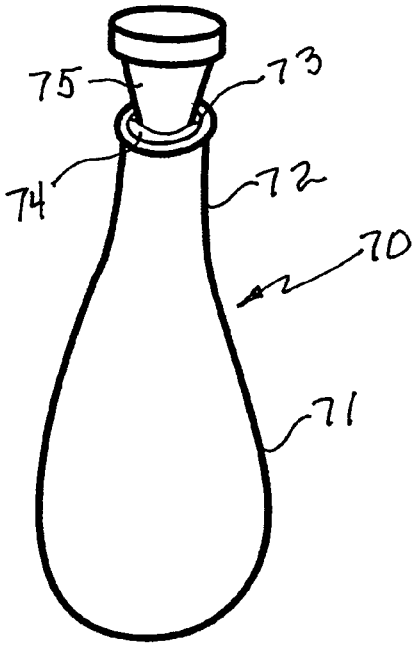
FIG. 11 sets forth a perspective view of the alternate embodiment of a self-sealing balloon set forth in FIG. 9 in a deflated condition and having an inflation nozzle fully inserted therein.

FIG. 11 again sets forth the perspective view of balloon 70 having skin 71, neck 72 and mouth 73. Also shown is valve 74. To fill or inflate balloon 70, nozzle 75 is shown fully inserted into valve 74. It will be noted that flaps 76 and 77 part to receive nozzle 75 and form a seal around nozzle 75. Thus, gas or liquid, under pressure may fill or inflate the balloon. Once the desired filling or inflation is complete, nozzle 75 is withdrawn and valve 74 closes.

Figure 12:
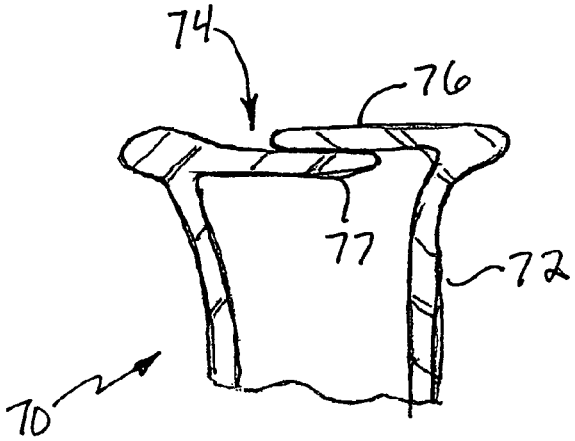
FIG. 12 sets forth a section view of the valve used in the alternate embodiment of the present invention self-sealing balloon shown in FIG. 9.

FIG. 12 sets forth a partial section view of valve 74 and neck 72. As can be seen, valve 74 includes a pair of partially over-lapping valve flaps 76 and 77. In the closed configuration shown in FIG. 12, valve flaps 76 and 77 are forced together by the pressure within the balloon.

Figure 13:
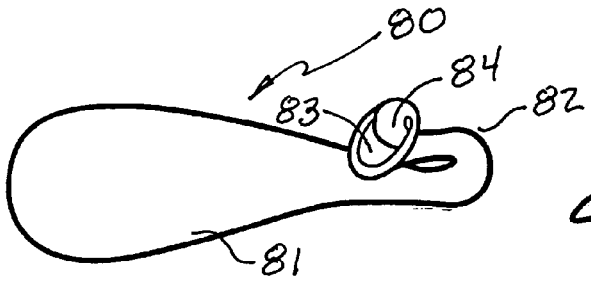
FIG. 13 sets forth a perspective view of a further alternate embodiment of a self-sealing balloon constructed in accordance with the present invention in a deflated condition.

FIG. 13 sets forth a perspective view of a still further alternate embodiment of the present invention self sealing balloon generally referenced by numeral 80. Balloon 80 differs from balloon 10 described above with the addition of a further sealing valve 84. Thus, balloon 80 includes a skin 81 and neck 82 which, in turn, forms a mouth 83.

Figure 14:
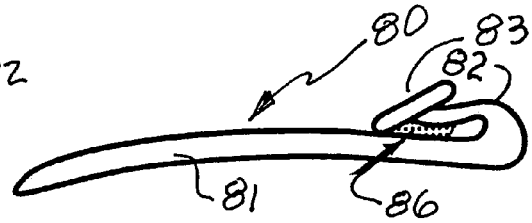
FIG. 14 sets forth a perspective view of the further alternate embodiment of a self-sealing balloon shown in FIG. 13 having the neck folded and attached.

FIG. 14 shows balloon 80 having neck 82 folded upon skin 81 and secured by an attachment 86 in a similar manner to that shown for balloon 10 shown and described above in FIGS. 1 through 6. Additionally, valve flap 84 provides further sealing of balloon 80.

Figure 15:
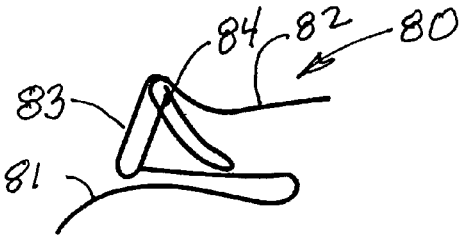
FIG. 15 sets forth a partial section view of the further alternate embodiment of a self-sealing balloon shown in FIG. 13 having the neck folded and further showing the flapper valve.
Figure 16:
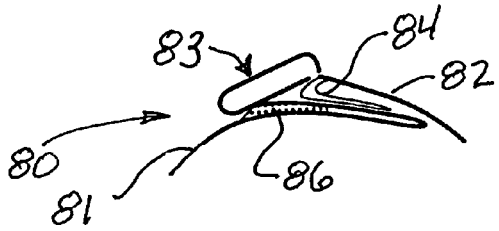
FIG. 16 sets forth a partial section view of the further alternate embodiment of a self-sealing balloon.
Figures 17, 18:
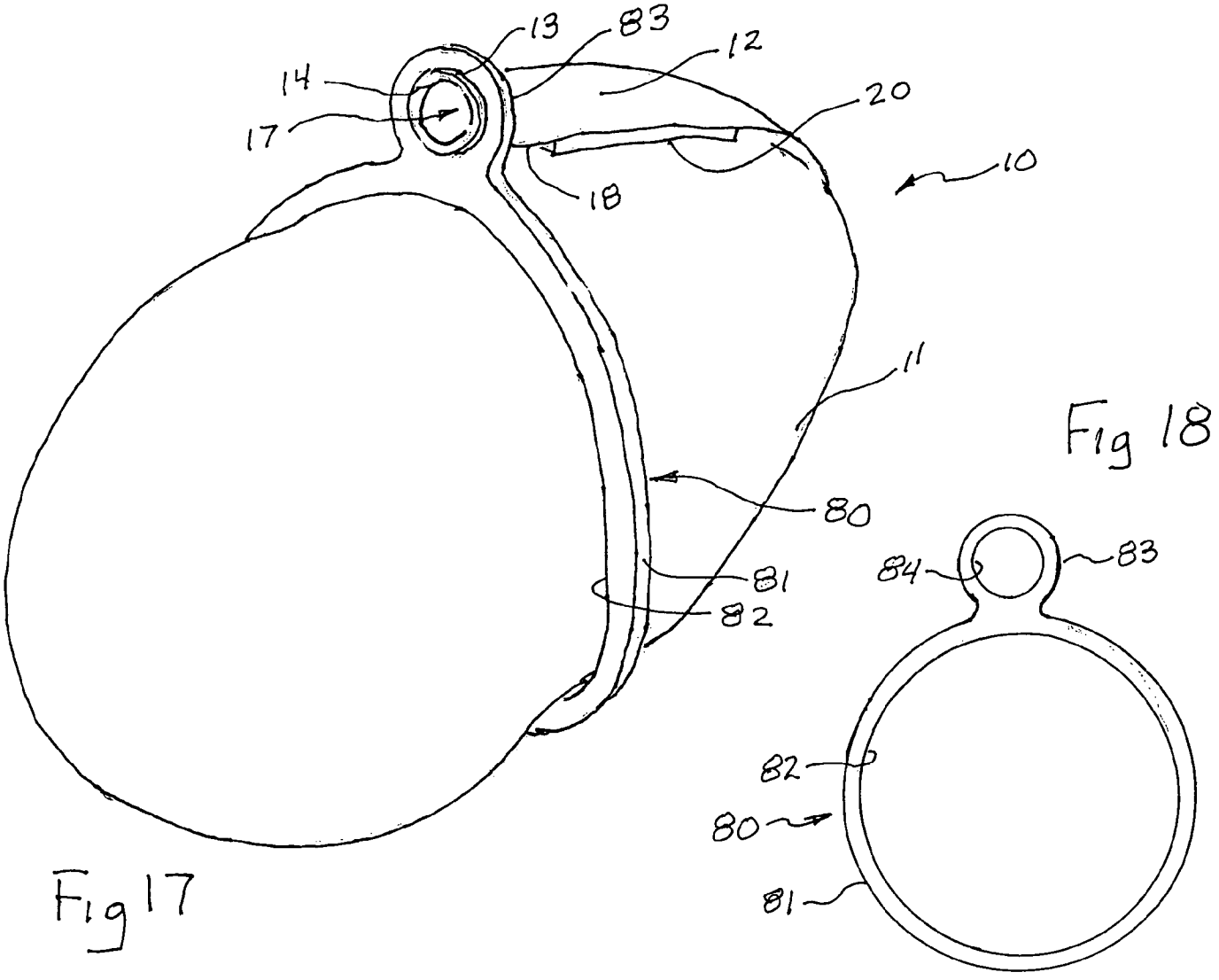
FIG. 17 sets forth a perspective view of an alternate embodiment of a self-sealing balloon constructed in accordance with the present invention supporting a neck retaining ring.
FIG. 18 sets forth a neck retaining ring constructed in accordance with the present invention.

FIGS. 15 and 16 set forth partial section views of the operation of valve 84. In FIG. 15, balloon 80 is shown deflated while in FIG. 16 balloon 80 is shown inflated FIG. 17 shows balloon 10 further including a neck retainer 80 which supplements the fixing of neck 12 against skin 11. Thus, as described above, balloon 10 includes a resilient stretchable skin 11 formed to confine an interior volume). Skin 11 is coupled to a filler neck 12 which is preferably continuously formed with skin 11. Filler neck 12 defines a neck aperture 14 surrounded by a neck rim 13. As is also mentioned above, filler neck 12 is hollow and generally cylindrical and thus includes a filler passage extending therethrough. Neck 12 and neck rim 13 provide a means for holding balloon 10 and for introducing fluid under pressure into the interior of skin 11. In accordance with the present invention, a quantity of adhesive 20 is deposited upon skin 11 in proximity to filler neck 12. In further accordance with the present invention, filler neck 12 has been folded upon skin 11 in the manner shown above in FIG. 1 and as is better seen above in FIGS. 5 and 6. Of importance with respect to the present invention is the attachment and restriction of movement exerted against filler neck 12 by adhesive deposit 20. It will be noted that while a deposit of adhesive material is suitable for fixing filler neck 12 against skin 11, other fixing and attachment apparatus such as double-sided tape or processes such as sonic or chemical welding may be utilized without departing from the spirit and scope of the present invention. FIG. 17 also shows adhesive 20 ending upon filler neck 12 to define a gap 18 between rim 13 and adhesive 20. Gap 18 facilitates the grip of neck 12 required by automatic filling apparatus and also facilitates attachment of neck 12 to neck retainer 80. Neck retainer 80 further secures neck 12 and is particularly advantageous for use with heavier fluids and the like.

Neck retainer 80 is preferably formed of a molded plastic or other somewhat rigid material. As is best seen in FIG. 18, neck retainer 80 defines a larger band 81 having a larger aperture 82 formed therein and a smaller band 83 having a smaller diameter aperture 84 formed therein. Neck retainer 80 is secured to balloon 10 by passing large band 81 onto skin 11 of the balloon. Thereafter, rim 13 of neck 12 is passed through smaller aperture 84 to provide the assembly shown in FIG. 17. When thus installed, neck retainer 80 provides an additional attachment for neck 12 supplementing the attachment provided by attachment 20.

FIG. 18 sets forth neck retainer 80 which defines a larger band 81 having a larger aperture 82 formed therein and a smaller band 83 having a smaller diameter aperture 84 formed therein.

It will be apparent to those skilled in the art that the present invention self-sealing balloon or bladder provides considerable advantage in conventional gas-filled balloons of the type typically played with by children as well as sturdier and heavier structures such as the bladders often employed within the interior of various sport balls as well as a variety of industrial apparatus. Thus, when applied to an amusement device such as a lightweight thin balloon filled with air or lighter than air gas to provide buoyancy, the minimum structure required by the present invention system to produce a reliable self-sealing performance does not interfere with the conventional types of amusement play carried forward with such devices. Particularly in connection with lighter than air gasses filling the balloon to provide buoyancy within the air, the minimum weight added by the present invention system enjoys particular advantage. In addition, the ease of fabrication which may be carried forward with virtually any otherwise conventional balloon or similar inflatable device facilitates virtually endless variety of play and amusement devices. With respect to applications of the present invention self-sealing balloon or bladder to sturdier heavier weight bladder-type apparatus, the economy and ease of fabrication enjoy corresponding benefits and appeal. The cost of the present invention self-sealing system is substantially reduced from the cost of other, more conventional valves and valve systems.

It has been noted above that the present invention is, for the most part, described in the embodiments set forth herein illustrating the use of the present invention system in filling a balloon or bladder with a fluid such as a liquid or gas. However, as mentioned above, it will be understood that the present invention system is not limited to a fluid such as liquid or gas material. The present invention system is equally applicable to virtually any "flowable" material. As used herein, the term flowable embraces virtually any material which is not defined in a retained shape but rather assumes the shape of its surroundings. Thus, particulate materials not normally thought of in filling bladders and balloons such as fine powder, coarse powder, sand or even granular material may benefit from the present invention. It has been found that such flowable materials may be introduced into the balloon or bladder interior causing a stretching of the elastic material from which the balloon or bladder is formed. In such event, the elastic characteristic of the balloon or bladder body cooperates with the flowable material to provide a closure force operative upon the balloon or bladder neck in virtually the same manner as depicted above in FIGS. 5 and 6. Accordingly, as used herein, the term "flowable material" will be understood to embrace and include fluids such as gas or liquid as well as other materials such as powder, sand or granular materials without departing from the spirit and scope of the present invention.

What has been shown is a self-sealing balloon or bladder apparatus utilizing a resilient stretchable material balloon having a closed skin fluid reservoir coupled to an extending filler neck. In accordance with the invention, the filler neck of the balloon is folded back upon the body of the balloon skin and secured to the underlying portion of the balloon skin to fix the filler neck against the underlying balloon body surface. The fixing of the filler neck against the balloon body surface may be provided using a suitable adhesive material, a double-sided tape or other fixing methods and apparatus. The resulting balloon structure or bladder provides a suitable structure for quickly filling or inflating the balloon and sealing the confined fluid within the balloon interior. The closure of the balloon is provided by the captivation and attachment of the filler neck upon the outer surface of the balloon body. A reliable seal is provided once the fluid has been introduced under pressure by the action of the confined fluid volume of within the balloon exerted against the balloon skin and restrained neck secured to the balloon body. The self-sealing balloon or bladder readily accommodates an automated system of filling balloons and may further accommodate and automated system which dispenses individual balloons in a cartridge or clip form to create multiple-filled balloons in a short period of time.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A method of producing a self-sealing balloon comprising the steps of:

providing a balloon formed of an elastic material and defining generally bulbous skin enclosing an interior volume and an elongated filler neck defining an obstruction-free filler passage therethrough, said filler passage being in fluid communication with said interior volume;

folding said filler neck upon said skin to generally flatten said filler neck against a portion of said skin and collapse said filler passage;

adhesively fixing a portion of said filler neck to the underlying portion of said skin to maintain said filler neck at said position obtained in said folding step; and introducing a pressurized fluid flow into said neck to inflate and open said collapsed filler passage and flow said fluid into said interior volume thereby inflating and expanding said skin, whereby said fluid flow pressurizes said interior volume and expands said skin such that said elongated filler neck is collapsed against said skin and said filler passage is closed to seal said interior volume once said step of introducing a pressurized fluid flow ceases, said collapsed elongated filler neck and the resulting closure of said filler passage being maintained solely by said expanded skin and said adhesive attachment without additional valve or seal apparatus within or around said filler passage.

2. A method of producing a self-sealing balloon comprising the steps of:

providing a balloon having an elastic skin bladder enclosing an interior volume and outer skin surface and a filler neck defining a filler passage therethrough, said filler passage being in fluid communication with said interior volume, said filler passage being free of any obstruction or valve apparatus;

depositing an adhesive attachment upon a portion of said outer skin surface; and folding said filler neck upon said outer skin surface and upon said adhesive attachment to secure said filler neck to said outer skin surface, said step of depositing an adhesive attachment includes locating said adhesive attachment to ensure that said filler neck is folded flatly upon said outer skin surface;

whereby fluid introduced into said filler passage flows through said filler passage into said interior volume inflating said elastic skin bladder causing said elastic skin bladder to expand against said filler neck and collapse said filler passage such that, once said elastic skin bladder is inflated and expanded, the expansion of said elastic skin bladder forces and maintains closure of said filler passage and seal of said interior volume without additional seal or closure apparatus once the introducing of a pressurized fluid flow into said filler passage is terminated.

* * * * *